US006226870B1

(12) United States Patent
Barish

(10) Patent No.: US 6,226,870 B1
(45) Date of Patent: May 8, 2001

(54) ELECTRICAL SHAVER AND AUXILIARY DEVICE PARTICULARLY USEFUL THEREWITH

(76) Inventor: Benjamin J. Barish, 36 Yehuda Hanassi Street, 69 206 Tel Aviv (IL)

( * ) Notice: Subject to any disclaimer, the term of this patent is extended or adjusted under 35 U.S.C. 154(b) by 0 days.

(21) Appl. No.: 09/312,765

(22) Filed: May 17, 1999

Related U.S. Application Data

(60) Provisional application No. 60/099,347, filed on Sep. 8, 1998.

(51) Int. Cl.[7] ..... B26B 19/14
(52) U.S. Cl. ..... 30/43.6; 30/34.2
(58) Field of Search ..... 30/34.2, 43.6, 30/43.9, 43.92, 45, 32, 386.51; 74/17.8

(56) References Cited

U.S. PATENT DOCUMENTS 3,172,416 3/1965 Simmons ..... 30/538
3,310,693 * 3/1967 Aronoff ..... 74/17.8 X
3,992,775 * 11/1976 De Vries ..... 30/34.2
4,653,519 * 3/1987 Kanner ..... 74/17.8 X
5,621,971 * 4/1997 Szymansky ..... 30/34.2 X

FOREIGN PATENT DOCUMENTS

69118 * 1/1940 (CS) ..... 30/43.92

* cited by examiner

*Primary Examiner*—Douglas D. Watts

(57) ABSTRACT

An electrical shaver includes a sealing end wall blocking the passage of liquid from the cutter head (preferably a plurality of cutter heads) to the electrical motor within the housing, and a magnetic coupling coupling the cutter head to the electrical motor by a magnetic field which penetrates the sealing end wall, thereby enabling the shaver also to be used for a wet shave as well as for a dry shave. In one described embodiment, the cutter head includes a rotary cutter member, a static cutter member enclosing the rotary cutter member, and a scraper member having a thin, hard, scraper edge at least partially enclosing the static cutter member and spaced radially from its outer edge so as to erect the hairs, and to taughten the skin as the static cutter member is moved over the skin while pressed against it to cut the hairs. Further described is an auxiliary device for cleaning and/or drying the shaver head after use in a wet shave or dry shave.

23 Claims, 8 Drawing Sheets

ELECTRICAL SHAVER AND AUXILIARY DEVICE PARTICULARLY USEFUL THEREWITH

RELATED APPLICATION

The present application is based on Provisional Application Ser. No. 60/099,347, filed Sep. 8, 1998, and claims the priority date of that application.

FIELD AND BACKGROUND OF THE INVENTION

The present invention relates to electrical shavers, and also to an auxiliary device particularly useful with such electrical shavers. The invention is especially applicable to the rotary-type electrical shaver, and is therefore described below with respect to that application; but it will be appreciated that the invention could be used in other electrical shavers as well.

Two basically different techniques are now used for shaving: the "wet shaving" technique, using wet soap (or lather or shaving cream) and a razor blade (straight blade or safety blade); and the "dry shaving" technique, using an electrical shaver and no soap (or lather or shaving cream). Each technique has its own advantages and disadvantages. The main advantages of the "wet shave" are the ability of obtaining a close shave, the refreshing after-feeling produced after the shave, and the convenience of cleaning by merely rinsing the blade; whereas the main advantages of the "dry shave" are the convenience of shaving whenever and as frequently as desired, the reduced danger of nicking, cutting or irritating the skin, and the elimination of the expense of frequent blade replacement since electrical shavers are generally self-sharpening during use.

Since the advantages of the "wet shaving" technique stem from the use of wet soap, lather or shaving cream, it would be very desireable to be able to use an electrical shaver also for wet shaving. The vibratory-type electrical shaver has been adapted for wet shaving since this type of shaver involves very small vibratory movements. However, insofar as I am aware, the rotary-head type electrical shaver has not been adapted for wet shaving. Actually, the instructions accompanying a very popular rotary-type electrical shaver expressly caution against wetting the cutter head.

OBJECTS AND BRIEF SUMMARY OF THE INVENTION

An object of the present invention is to provide an electrical shaver particularly, but not exclusively, of the rotary-head type with a construction enabling the shaver to be used for wet shaving as well as for dry shaving, and thereby to provide the advantages of wet shaving.

A further object of the present invention is to provide an electrical shaver which better erects the hairs to be shaven, and/or better taughtens the skin, particularly while wet shaving, to enable closer shaves to be attained as compared to the present electrical shavers, by actions similar to those produced by the very popular 2-blade or 3-blade safety razors.

A still further object is to provide an auxiliary device particularly useful with the new electrical shaver for cleaning the cutter head, and/or for drying it when used with wet soap.

According to one broad aspect of the present invention, there is provided an electrical shaver, comprising: a housing including an electrical motor within the housing, and at least one cutter head carried by the housing and coupled to the electrical motor so as to be driven thereby; characterized in that the housing includes a sealing end wall blocking the passage of liquid from the cutter head to the electrical motor; and in that the cutter head is magnetically coupled to the electrical motor, so as to be driven thereby, by a magnetic field which penetrates the sealing end wall.

According to further features in the described preferred embodiments, the cutter head is magnetically coupled to the electrical motor by at least one drive magnet on one side of the sealing end wall mechanically coupled to the electrical motor, and at least one driven magnet on the opposite side of the sealing end wall mechanically coupled to the cutter head.

According to another aspect of the present invention, there is provided an electrical shaver comprising: a housing closed at one end by a sealing end wall, the housing including an electrical motor and a drive magnet at one side of the sealing end wall mechanically coupled to the electrical motor; and a shaver head assembly preferably removably attached to the one end of the housing, the shaver head assembly including a cutter head and a driven magnet mechanically coupled thereto and located at the opposite side of the sealing end wall when the shaver head assembly is attached to the housing; the driven magnet being magnetically coupled to the drive magnet by a magnetic field penetrating the sealing end wall when the shaver head assembly is attached to the housing.

According to further features in the described preferred embodiments, the shaver head assembly includes a plurality, preferably three, of cutter heads each including a rotary cutter member driven by the electrical motor within the housing when the shaver head assembly is attached thereto.

According to another aspect of the present invention, there is provided an electrical shaver comprising a housing including an electrical motor; and a cutter head caried by the electrical motor. The cutter head includes a rotary cutter member; a static cutter member enclosing the rotary cutter member and formed with a plurality of slots for reciving hairs to be cut by the rotary cutter member as the static cutter member is pressed against and moved over a surface containing the hairs to be cut; and a scraper member having a thin, hard scraper edge at least partially enclosing the static cutter member and spaced radially from its outer edge such as to be effective to erect the hairs, and to tauten the surface containing the hairs, as the static cutter member is moved over, while pressed against, the surface containing the hairs to be cut. These features, particularly when the electrical shaver is used for a wet shave, produce hair-erecting and skin-taughtening actions comparable to those produced by the two-blade or three-blade safety razor.

As will be described more particularly below, such an electrical shaver may be used for taking a light dry shave, or a close wet shave; and particularly in the latter case, such a shaver will provide most or all the above advantages of a wet shave with a blade, in addition to those of a dry shave with an electric shaver. A still further advantage of the preferred embodiment of the invention described herein is that it can be implemented with but a few changes, involving little more than the addition of a few simple parts, in the rotary-type electrical shavers commercially-available today.

According to a further aspect of the invention, there is provided an auxiliary device particularly useful with the novel electrical shaver to facilitate drying and/or cleaning the shaver head assembly when it has been detached from the electrical shaver.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

General Construction

Figure 1:
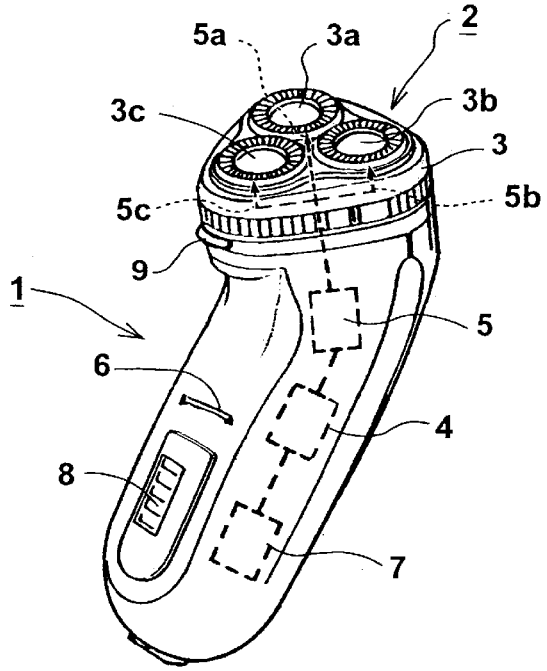
FIG. 1 is a three-dimensional view illustrating one form of rotary-type electrical shaver incorporating the present invention.

The electrical shaver illustrated in FIG. 1 is a well known rotary-type electrical shaver, such as sold by Philips Corporation in Europe, or by Norelco Corporation in the USA. It includes a housing, generally designated 1, of an elongated configuration to be readily grasped by the user, and a shaver head assembly 2 at one end to be pressed against and moved across the user's face or other surface to be shaved.

In the illustrated model, the shaver head assembly 2 includes a removable lid 3 of triangular configuration mounting three cutter heads 3*a,* 3*b,* 3*c* in a triangular array within openings 3*a*', 3*b*', 3*c*' (FIG. 4) in the lid; and the housing 1 includes an electrical motor drive 4, coupled by a transmission 5 having three rotary drive shafts 5*a,* 5*b,* 5*c,* for driving the cutter units 3*a,* 3*b,* 3*c* when the shaver head assembly is attached. Motor 4 is controlled by a manual switch 6 and is powered by a rechargable battery 7.

Housing 1 further includes light indicators 8 indicating the charge status of the battery 7, and a depressable release button 9 for releasing the shaver head assembly 2 to permit detaching it from the shaver housing The electrical shaver illustrated in FIG. 1 insofar as described above, is the Philishave 930 model sold by Phillips Corporation. The details of its construction and 1. operation are widely available in their published literature and are therefore not set forth, but rather are incorporated herein by reference.

The Magnetic Coupling

In the conventional electrical shaver as illustrated in FIG. 1, the three drive shafts 5*a,* 5*b,* 5*c* project through the end wall of housing 1 so as to be mechanically coupled to the cutter heads 3*a,* 3*b,* 3*c,* when the shaver head assembly is attached to that end of the housing. In contrast to this conventional construction, in the illustrated construction of the present invention, the end of housing 1 to receive the shaver head assembly 2 is hermetically closed by a sealing end wall 10 (FIGS. 2 and 4), which seals the interior of housing 1 at that end against liquid penetration. In addition, a magnetic coupling is provided between the cutter heads 3*a*–3*c* of the shaver head assembly 2 and the drive shafts 5*a*–5*c* of the motor drive 4. This magnetic coupling is effected by a magnetic field which penetrates the sealing end wall, and is produced by three drive magnets disposed within housing 1 on one side of the sealing end wall 10, and by three driven magnets disposed within the shaver head assembly 2 on the other side of the sealing end wall 10 when the shaver head is attached to the housing 1.

Figure 2:
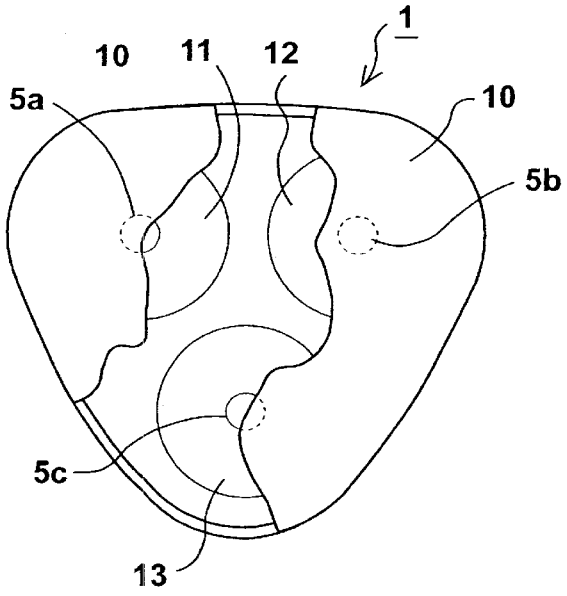
FIG. 2 is a plan view of the end of the housing of the shaver of FIG. 1 with the shaver head removed, and with the sealing end wall at that end of the housing partially broken-away to show internal structure.
Figure 3:
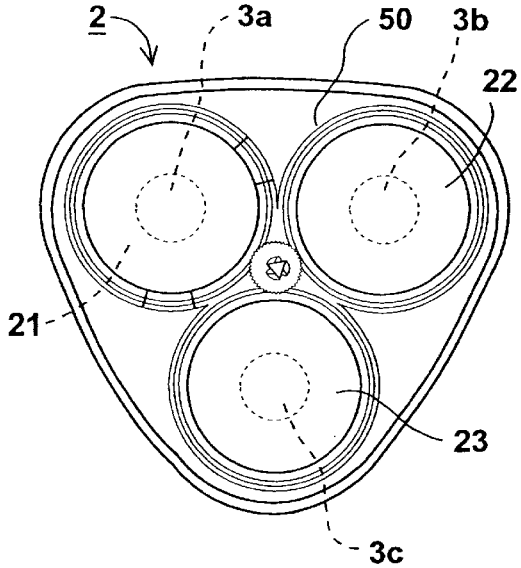
FIG. 3 is a plan view of the shaver head, when detached from the housing, showing the side of the shaver head to face the housing when attached thereto.

FIG. 2 illustrates the end of housing 1 as sealed by end wall 10 and as including the three drive magnets 11, 12 and 13, coupled to the three drive shafts 5*a,* 5*b,* 5*c* of the motor drive within the housing. FIG. 3 illustrates the corresponding side of shaver head assembly 2, which includes the three driven magnets, 21, 22, 23, carried by the lid 3 and coupled to the cutter heads (3*a,* 3*b,* 3*c,* FIG. 1) which magnets are located on the opposite side of the sealing end wall 10 of housing 1 when the shaver head lid 3 is attached to the housing.

Figure 4:
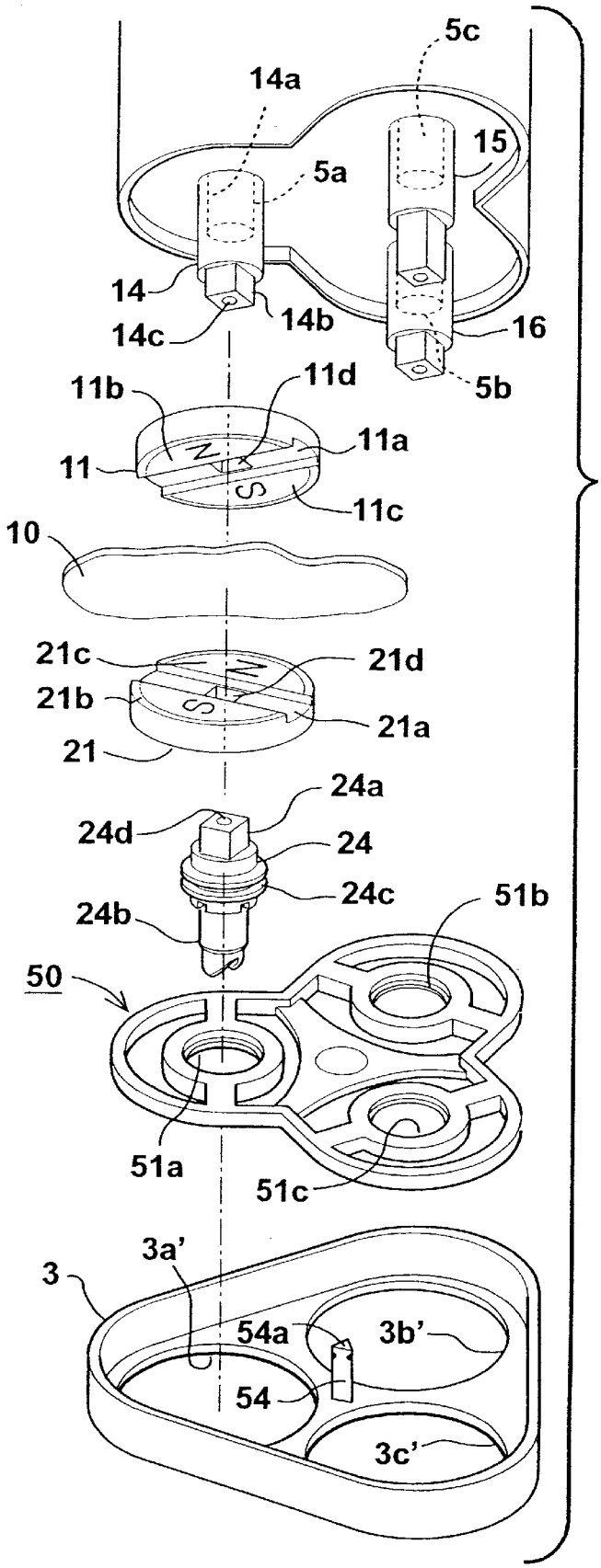
FIG. 4 is an exploded perspective view illustrating the basic components for producing the magnetic coupling between the electrical motor within the sealed housing, and the cutter heads (not shown) carried by the shaver head assembly.

FIG. 4 illustrates only one of the three drive magnets and one of the three driven magnets, namely magnets 11 and 21 in the coupling between drive shaft 5*a* on one side of end wall 10 within housing 1, and the cutter head 3*a* carried by the shaver head assembly 2 on the other side of the end wall. It will be appreciated that a similar arrangement is used for coupling the other two drive shafts 5*b*, 5*c* to their respective cutter heads 3*b*, 3*c*.

Figure 5A:
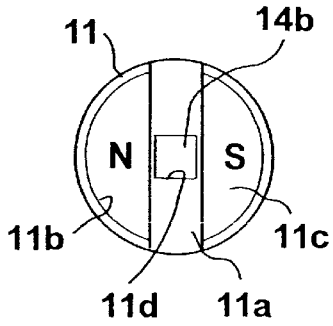
FIGS. 5*a,* 5*b* and 5*c* illustrate three constructions of permanent magnets which may be used as the drive magnets and driven magnets in the magnetic coupling of FIG. 4.

Each of these magnets is of disc configuration and is made of permanent magnetic material. Magnetic disc 11 of FIG. 4 (also FIG. 5*a*) is formed with a diametrical slot 11*a* on one face, dividing that face into two sections serving as magnetic poles 11*b*, 11*c*. It is further formed with a square hole 11*d* centrally of slot 11*a* for non-rotatably attaching it to the respective drive shaft 5*a*.

FIG. 4 illustrates this attachment effected via a plastic connector sleeve 14 formed with a bore 14*a* at one end secured to the drive shaft 5*a*, and with a square extension 14*b* at the opposite end for reception within the square hole 11*d* of the magnet disc 11. Square extension 14*b* of connector sleeve 14 is of a length so that its outer face is substantially flush with the outer face of the magnet disc 11. Preferably, however, the outer face of extension 14*b* is formed with a small semi-spherical projection or dimple 14*c* to provide a bearing surface for engagement with the sealing end wall 10 in order to slightly space the magnet disc from the end wall, while permitting the magnet disc to rotate rapidly with respect to the end wall.

The transverse slot 11*a* is formed in the face of the magnet disc 11 facing the end wall 10, so as to define the two poles 11*b*, 11*c* closely adjacent the end wall. The magnetic disc is magnetized such that this face defines a magnetic pole of one sense (e.g., North) in section 11*b* on one side of slot 11*a*, and a magnetic pole of the opposite sense (e.g., South) in section 11*c* at the other side of the slot.

Figure 5B:
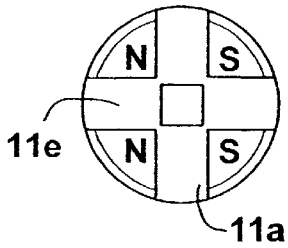
Figure 5C:
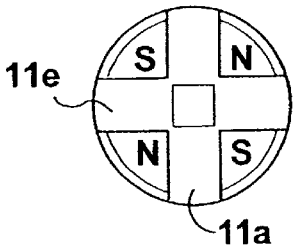

FIG. 5*b* illustrates a variation wherein this face of the magnetic disc 11 is formed with a second diametrical slot 11*e*, and the magnetic disc is magnetized to define four magnetic poles, namely two North poles on one side of slot 11*a*, and two South poles on the opposite side of the slot. FIG. 5*c* illustrates a similar construction, except the disc is magnetized such that the poles alternate in sense around the magnetic disc.

The two other drive magnets 12, 13, on the housing side of the sealing end wall 10, are similarly constructed and coupled to their respective drive shafts 5*b*, 5*c*, by the use of similar plastic connector sleeves 15, 16. Preferably, all the drive magnets 11, 12, 13 are fixedly attached to their respective drive shafts 5*a*, 5*b*, 5*c*, since they are sealed within the housing 1 by the sealing end wall 10.

The three driven magnets 21, 22, 23 carried by the shaver head assembly lid 3, are of similar construction as the drive magnets 11, 12, 13. They are located on the oposite side of end wall 10 in alignment with the drive magnets 11, 12, 13, respectively, when the shaver head assembly lid 3 is attached to the shaver housing 1 so as to be magnetically coupled to them.

FIG. 4 more particularly illustrates the construction and mounting of driven magnet 21, it being appreciated that the other driven magnets 22, 23 are similarly constructed and mounted.

Thus, as shown in FIG. 4, driven magnet 21 is also of disc shape and is formed with a transverse slot 21*a* in one face dividing that face into two magnetic poles 21*b*, 21*c*, and with a square hole 21*d* centrally of slot 21*a*. Driven magnet 21 is fixed to a plastic connector pin 24 having a square end 24*a* received within the square hole 21*d* in the magnet disc. In this case, however, the opposite end of pin 24 is formed with an axially-extending tooth formation 24*b*, similar to the construction in the drive shaft of the existing electric shaver, to provide a quickly-detachable mechanical coupling to its respective rotary cutter member for rotating it. An intermediate portion of connector pin 24 is thickened and formed with a peripheral groove 24*c* for rotatably mounting the magnet disc 21 within the shaver head assembly cap 20, by means of the spring retainer member 50, which yieldingly retains the cutter heads 3*a*, 3*b*, 3*c* within the shaver head assembly 2, as will be described more particularly below. The face of the square end 24*a* of the connector pin is also preferably formed with a small semi-spherical projection or dimple 24*d*, corresponding to projection 14*c* in connector sleeve 14, also for bearing and spacing purposes.

Construction of the Cutter Heads

Figure 10:
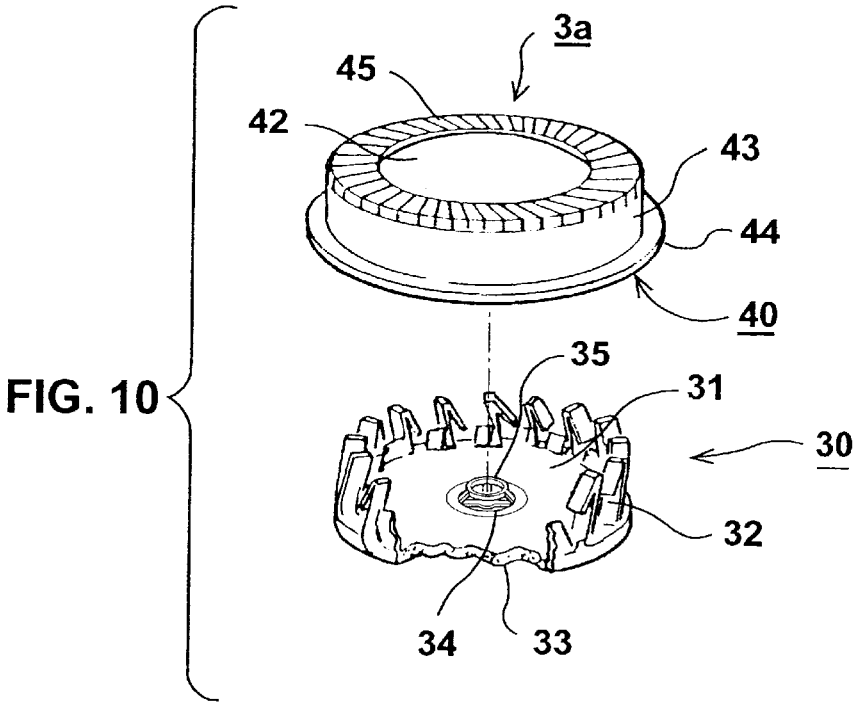
FIG. 10 is an exploded perspective view of one of the cutter heads in the shaver head assembly.

The cutter heads 3*a*–3*c* may be of the same construction as in the conventional electrical shaver. Thus each cutter head 3*a*, 3*b*, 3*c* includes a rotary cutter member 30 and a static cutter (or guard) member 40. FIG. 10 illustrates one face of the rotary cutter member 30 and the static cutter member 40, whereas FIGS. 11 and 12 illustrate the opposite faces of these members, respectively.

Figure 11:
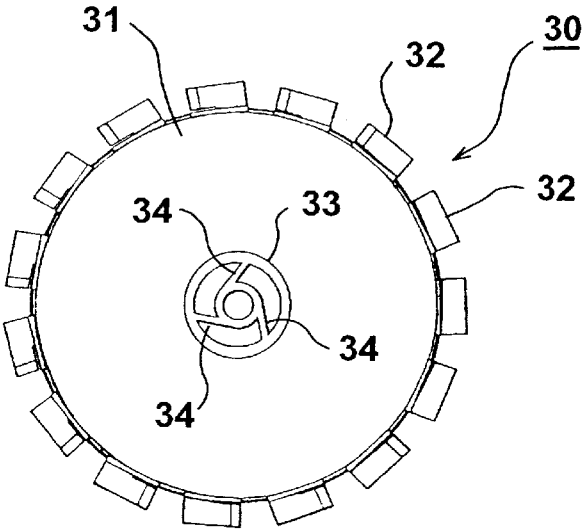
FIG. 11 is an enlarged plan view of the rotary cutter member in the cutter head of FIG. 10.
Figure 12:
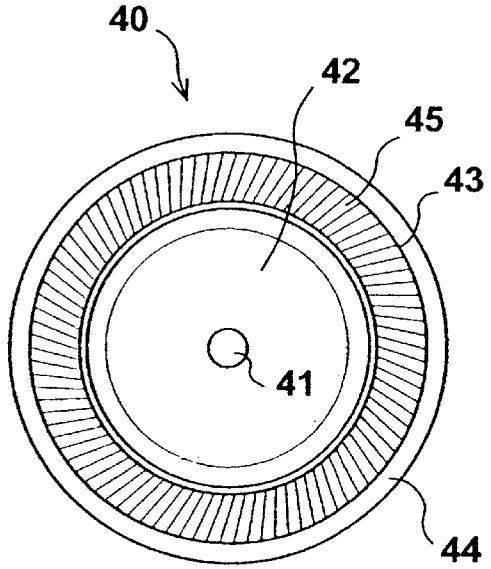
FIG. 12 is an enlarged plan view of the static cutter member in the cutter head of FIG. 10.

Thus, as shown in FIGS. 10–12, rotary cutter member 30 includes a circular disc 31 formed around its outer periphery with a circular array of cutter teeth 32 extending perpendicularly to the disc, i.e., axially of the shaver head 2. A hub 33 is fixed to the center of circular disc 31. Hub 33 is formed with three arms 34 (FIG. 11) for coupling to the motor drive within housing 1.

In the conventional electrical shaver, hub 33 is coupled directly to the drive shafts 5*a*–5*c* of the electrical motor drive by axially-extending teeth formed at the ends of the drive shafts when the shaver head assembly 2 is attached to the housing 1. However, in the illustrated shaver constructed according to the present invention as described below, the rotary cutter members 30 are not mechanically coupled to the drive shafts, but rather are magnetically coupled to them via the drive magnets 11–13 and the driven magnet 21–23. Accordingly, the end 24*b* of each connector pin 24 is formed with the same axially-extending teeth formation as in the end of the drive shafts in the commercial shaver to efect a mechanical coupling between the driven magnets 21–23 and the rotary cutter members 30 of the cutter heads 3*a*–3*c*.

The side of each rotary cutter member 30 facing the static cutter member 40, as shown in FIG. 10, includes a circular socket 35 for receiving the tip of a spacer pin 41 (FIG. 12) projecting from that side of the static cutter member. As in the commercial construction, the rotary cutter member 30, including its circular disc 31 and its teeth 32, is of metal; whereas central hub 33, including its arms 34 and socket 35, is of a hard plastic material.

Figure 6:
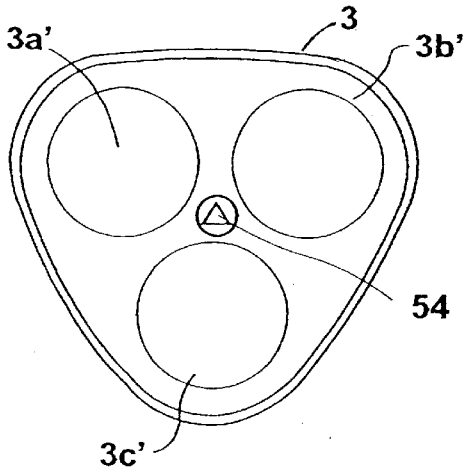
FIG. 6 is a plan view of the triangular lid in the shaver head assembly of FIGS. 3 and 4.

As also in the commercial construction, the static cutter member 40 is made of metal and is of cylindrical configuration. Its pin 41 (FIG. 12) facing socket 35 (FIG. 10) of the rotary cutter member 30, is integrally formed centrally of an end wall 42 circumscribed by a cylindrical skirt 43. Skirt 43 terminates in an outer annular flange 44 for mounting the static cutter member 40 within the respective opening 3*a*'–3*c*' (FIGS. 4, 6) in the lid 3 of the shaver head assembly 2. The outer periphery of wall 42 is formed with a circular array of hair-receiving slots 45. When pin 41 of the static cutter member 40 is received within socket 35 of the rotary cutter member 30, the teeth 32 of the rotary cutter member are spaced very close to the inner face of the static cutter member 40 in alignment with the slots 45 to cut the hairs received through these slots.

Mounting the Driven Magnets 21–23

Retainer member 50, presently included in the conventional shaver head 2 for removably retaining the cutter heads 3*a*–3*c*, is also used in the illustrated shaver for removably mounting the driven magnets 21–23. In the commercial construction, this member is made of plastic and is formed with three openings 51*a*, 51*b* and 51*c*, respectively (e.g., FIG. 4) for receiving the drive shafts 5*a*, 5*b*, 5*c* coupled to the cutter heads 3*a*–3*c* when the shaver head assembly is applied to the housing. In the illustrated shaver, however, openings 51*a*, 51*b*, 51*c* are, instead, used for rotatably mounting the three driven magnets 21–23 such that when the shaver head assembly is attached to the housing, the driven magnets 21–23 are magnetically coupled on one side to the drive magnets 11–13 within the shaver housing 1, and are mechanically coupled on the opposite side to the hubs 33 of the three cutter heads 3*a*–3*c* in the shaver head assembly 2.

Figure 8:
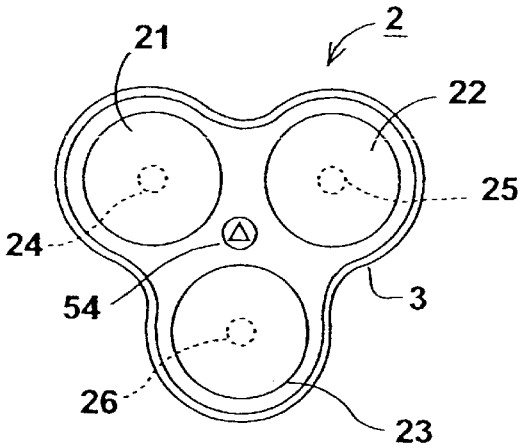
FIG. 8 is a plan view of the retainer member with the driven magnets rotatably mounted thereon in the shaver head assembly of FIGS. 3 and 4.
Figure 9:
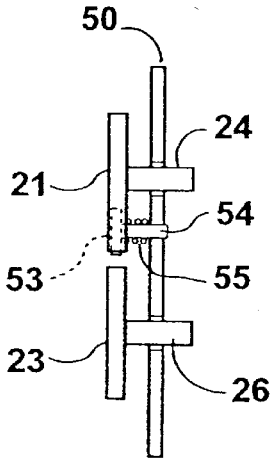
FIG. 9 is a side view of the retainer member with the driven magnets rotatably mounted thereon.

As described above, each of the driven magnets 21–23 carried by the retainer member 50 is fixed to one end of a pin 24–26 (FIGS. 4, 8 and 9), rotatably mounted within openings 51*a*–51*c* of the retainer member 50. The opposite end of each pin 24–26 includes the axially-extending teeth (e.g., 24*b*, FIG. 4) adapted to be coupled to arms 34 (FIG. 11) in the rotary cutter member 30 of the respective cutter head 3*a*–3*c* when the retainer member 50 is mounted on the shaver head assembly 2, and the shaver head assembly is attached to the end of the shaver housing 1 sealed by the sealing end wall 10.

Figure 7:
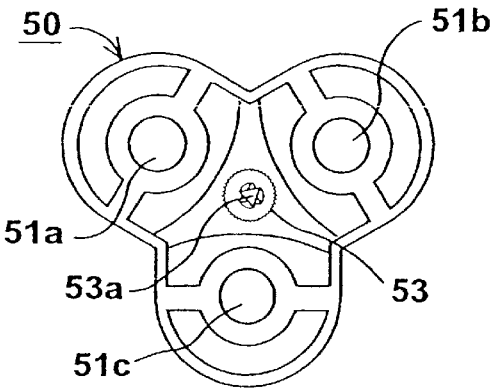
FIG. 7 in a plan view of the retainer member in the shaver head assembly of FIGS. 3 and 4.

As in the present commercial construction, retainer member 50 is provided with a rotatable knob 53 manually accessible from the outer side of the retainer member when the shaver head assembly 2 is detached from housing 1, for releasably retaining it in the shaver head assembly. Knob 53 is formed with a triangular socket (53*a*, FIG. 7) at its inner side for receiving the triangular tip of a pin 54 (FIG. 4) centrally of the shaver head lid 3. Also, as in the present construction, a spring 55 (FIG. 9), between knob 53 and the retainer member 50, spring-urges the retainer member against the open ends of the static cutter members 40 of the cutter heads 3*a*–3*c* when the retainer member is in its retaining position, and permits the cutter heads to be individually displaced inwardly witin lid 3 to conform to the curvature of the user's face or other surface being shaved.

Some Variations in the Coupling Arrangements

Figure 13:
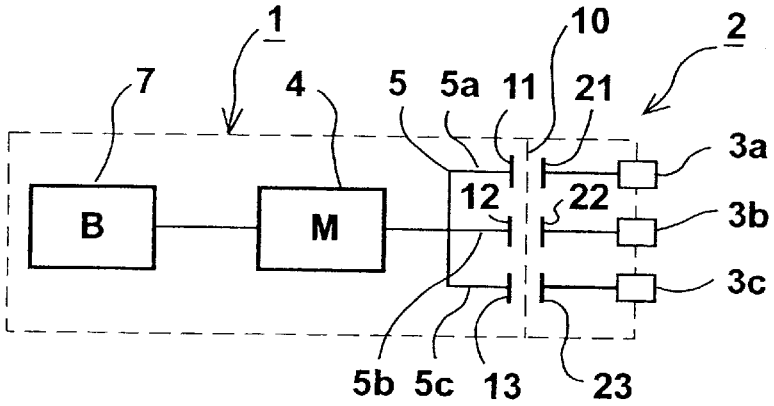
FIG. 13 is a diagram illustrating the mechanical and magnetic coupling arrangement between the electrical motor and the three cutter heads in the electrical shaver of FIGS. 1–12.

The mechanical and magnetic coupling arrangement in the electrical shaver described above with respect to FIGS. 1–12 is schematically shown by the diagram of FIG. 13. In this arrangement, the three drive magnets 11–13 are mechanically coupled to their respective drive shafts 5*a*–5*c* and magnetically coupled to the three driven magnets 21–23; and when the shaver head assembly is attached, the three driven magnets are in turn mechanically coupled to their respective cutter heads 3*a*–3*c*. This arrangement has the important advantage of minimizing redesign of the existing rotary-type electrical shavers, since the basic electrical shaver design stays the same. Thus, this implementation of the invention requires very little more than the addition of the sealing end wall and the two sets of magnetic discs. The mass of the driven discs determines the "fly-wheel" inertia tending to produce uniform rotation of the cutter heads when loaded during the cutting action.

FIGS. 14–18 schematically illustrate other mechanical and magnetic coupling arrangements that may be used to implement the invention.

Figure 14:
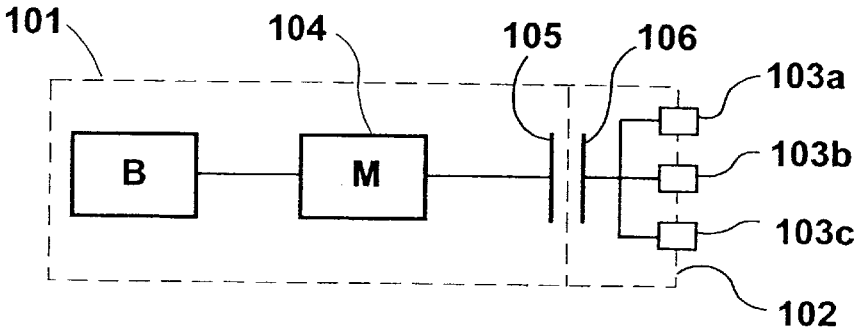
FIGS. 14–18 are corresponding diagrams illustrating a number of variations in the mechanical and magnetic coupling arrangements that may be provided.

FIG. 14 illustrates an arrangement including one large drive magnet 105, of disc shape within the shaver housing 101, which is mechanically coupled to the electrical motor 104 and magnetically coupled to another large magnetic disc 106 within the shaver head assembly 102 and mechanically coupled to the cutter heads 103*a*–103*c* in that assembly. Such an arrangement has the capability of producing a larger magnetic coupling force between the driving and driven magnets, and also of increasing the "fly wheel" inertia of the cutter heads to thereby produce a more uniform rotational velocity of the cutter heads under varying load conditions.

Figure 15:
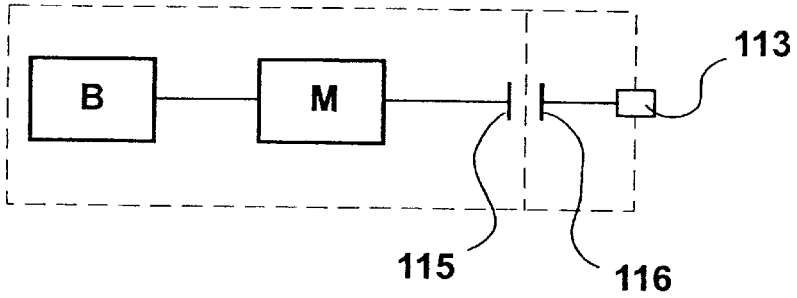
Figure 16:
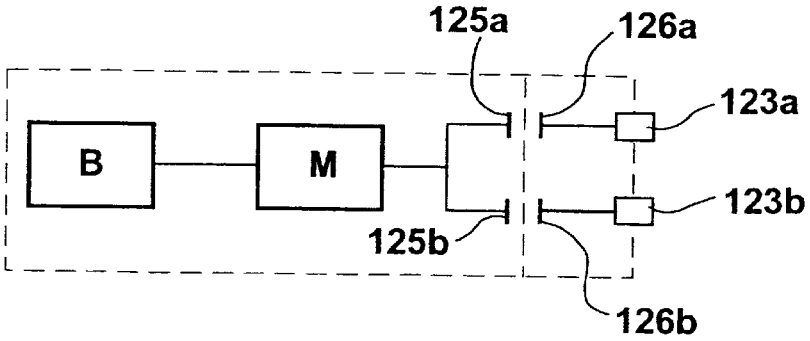
Figure 17:
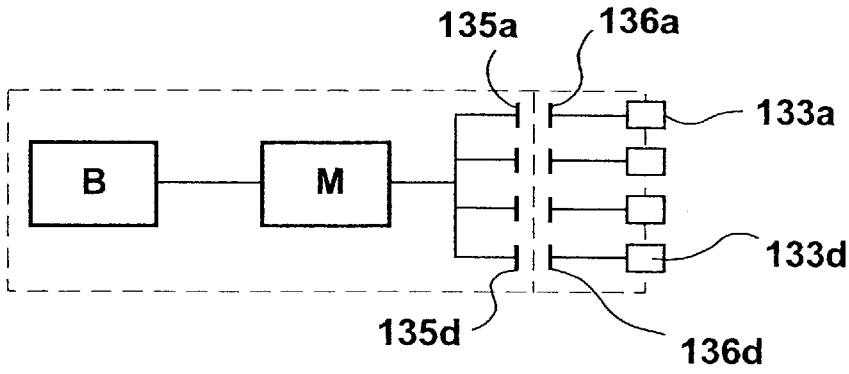

FIGS. 15, 16 and 17 schematically illustrate implementations similar to that of FIG. 13, but including only one cutter head (113, FIG. 15), or two cutter heads (123*a*, 123*b*, FIG. 16), or four cutter heads (133*a*–133*d*, FIG. 17), with the corresponding number of drive and driven magnets (115, 116; 125*a*, 125*b*, 126*a*, 126*b*; 135*a*–135*d*, 136*a*–136*d*, respectively). It will be appreciated that the arrangement of FIG. 14 could also be incorporated in any of these implementations.

Figure 18:
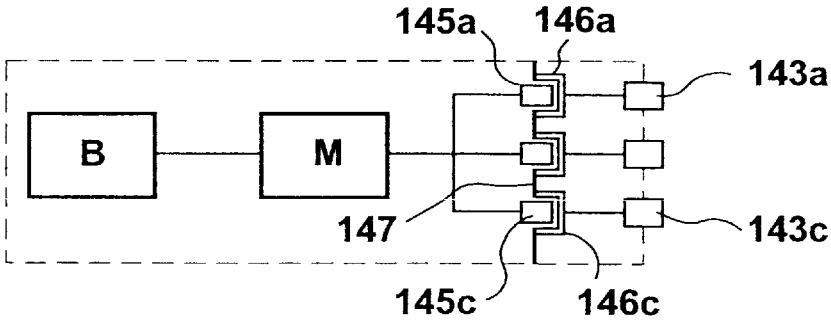

FIG. 18 illustrates an electrical shaver including three rotary heads 143*a*–143*c*, similar to the construction described above and schematically illustrated in FIG. 13, except that, instead of coupling the drive magnets 145*a*–145*c* to their respective driven magnets 146*a*–146*c* via axial magnetic fields through the sealing end wall 147, the magnets are magnetically coupled via radial magnetic fields. Thus, the sealing end wall 147 is formed with cylindrical cavities; the drive magnets 145*a*–145*c* are of solid cylindrical shape received within these cavities; and the driven magnets 146*a*–146*c* are of hollow cylindrical shape enclosing the cylindrical cavities and the drive magnets therein, so that each driven magnet is magnetically coupled to its respective drive magnet by a radial magnetic field penetrating the sealing end wall 147. Such an arrangement has the advantage of more compactness radially since it enables the magnetically-coupled surfaces to be increased axially.

Figure 19:
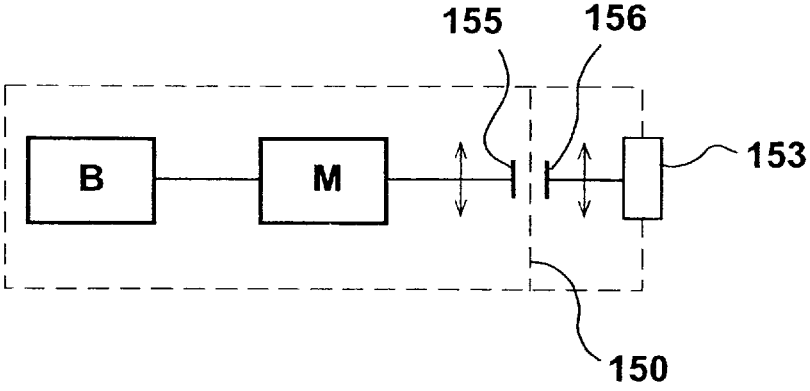
FIG. 19 is a diagram illustrating a magnetic coupling arrangement which may be provided in a vibratory-type electrical shaver.

FIG. 19 illustrates the invention implemented in a vibratory-type electrical shaver also provided with a sealing end wall 150. Thus, the vibratory cutter head 153 is magnetically coupled to the electrical motor by a vibrated drive magnet 155 and a driven magnet 156 on the opposite side of the sealing end wall 150, which is mechanically coupled to the vibratory cutter head 153.

Shaver Head with Scraper

Figure 20:
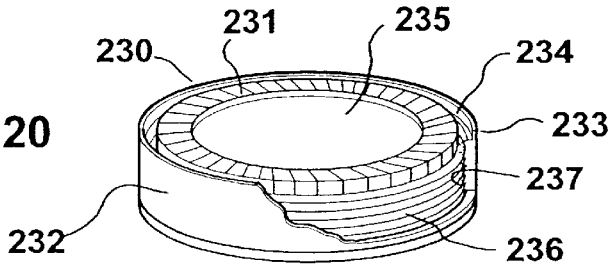
FIG. 20 is a perspective view, partly broken away, showing the optional provision of a scraper member enclosing the static cutter member in one of the cutter heads.

FIG. 20 illustrates a modification that may be included in the cutter heads providing a number of advantages particularly when the electrical shaver is used for taking a wet shave.

In this modification, each static cutter member 230 is enclosed by a scraper member 232, preferably of metal having a thin scraper edge 233 slightly spaced radially outwardly from the outer slotted edge 231 of the static cutter member to define an annular space 234 between it and the scraper member 232. While taking a wet shave, when the end wall 235 of the static cutter member 230 is pressed against and moved across the face (or other surface having the hairs to be removed) to cut the hairs, the scraper edge 233 of scraper member 232 is efefctive to engage the hairs, and to erect them, and also to tauten the skin, just before the hairs are received within the slots 231 of the static cutter member 230. The action by scraper member 232 is somewhat comparable to the action produced when a 2-blade or 3-blade safety razor is used during a wet shave, and therefore aids the electrical shaver also to produce a close shave for the same reasons.

The scraper member 232 is preferably adjustable axially with respect to the outer edge of the static cutter member 230 to adjust the degree of the scraping action. For this purpose, the outer surface of the static cutter member 230, and the inner surface of the scraper member 232, are provided with mating threads 236 and 237, respectively, such that rotating scraper member 232 in one direction will extend its scraper edge 233 outwardly with respect to the outer edge of the static cutter member 230, whereas rotating member 232 in the opposite direction will recess it inwardly with respect to that edge. Preferably, the normal position of the scraper member 232 is with its scraper edge 233 substantially aligned with the outer edge of the static cutter member 230 such as to produce a mild scraping action when the end wall 235 of the static cutter member 231 is pressed against the user's face (or other surface) while taking a shave.

Figure 21:
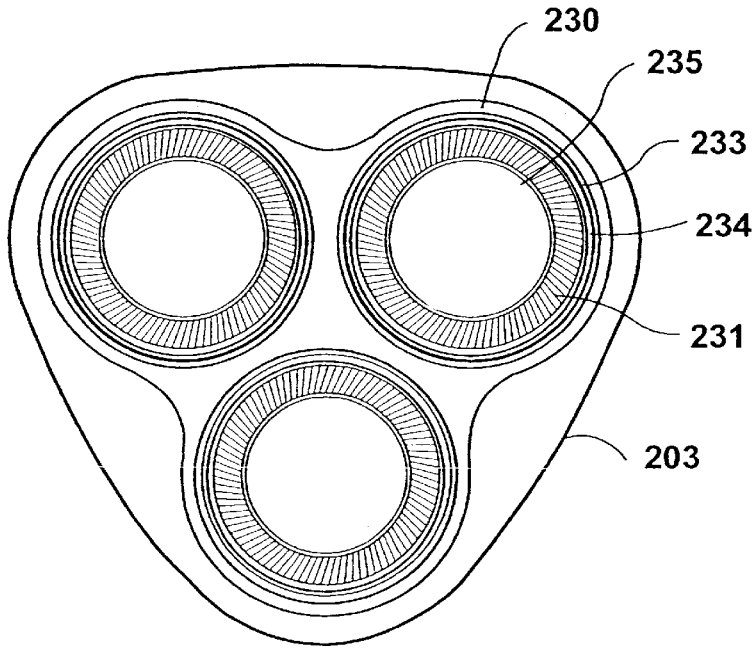
FIG. 21 is a plan view of the shaver head assembly with each cutter head including a scraper member as illustrated in FIG. 20.

FIG. 21 is a plan view illustrating a three-head electric shaver assembly 203, wherein the static cutter member 230 of each shaver head is provided with such a scraper member 232, with the thin scraper edge 233 radially spaced therefrom by the annular space 234.

The manner of adjusting each scraper member 232 described above with respect to FIG. 20 requires separate adjustment of each of the cutter heads. In most cases, this would be a one-time adjustment performed at the factory or at a local service station. However, the described construction also enables the user to individually adjust the degree of scraper action if and when desired.

Figure 22:
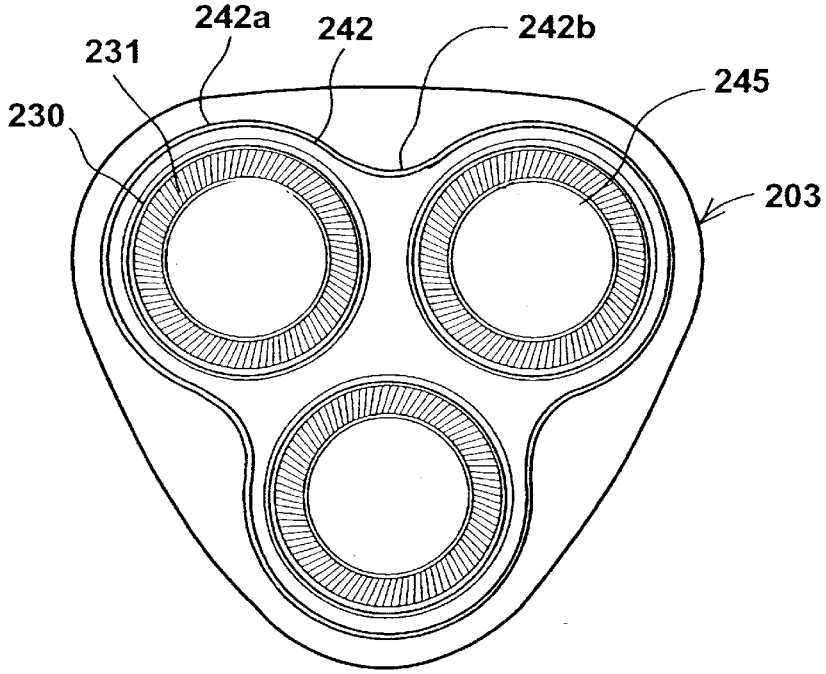
FIG. 22 is a view similar to that of FIG. 21, but including a common scraper member for all the cutter heads.

FIG. 22 illustrates a modification wherein a common scraper member 242 is provided to enclose the static cutter members 230 of all the cutter heads in the shaver assembly. In the modification illustrated in FIG. 22, the commn scraper member 242 is of a clover-leaf configuration, to include outwardly-extending sections 242*a* of approximately semi-circular shape closely following the configuration of approximately the outer one-half circumference of the static cutter members 230, interconnected by inwardly-extending valley sections 242*b*. The valley sections 242*b* contribute very little, if any, to the hair-erecting and skin-tautening functions described above, and therefore these sections may be made flush with, or recessed with respect to, the outer faces of the static cutter members 231, or omitted altogether.

In the Philishave 930 commercial model, selected as the preferred embodiment for describing the present invention, the three cutter heads (corresponding to 230 in FIG. 22) are manually adjustable by an adjustment ring circumscribing the shaver head assembly lid 3 to adjust the distance at which the cutter units (particularly the outer face of its end wall 235) projects outwarly to thereby adjust the shaving performance relative to the skin irritation. This is also described in European Patent 0231966. U.S. Pat. No. 5,687,481, describes a construction for effecting this adjustment automatically during the shaving operation. It will be appreciated that the individual scraper members 232 of FIGS. 20 and 21, and particularly the common scraper member 242 of FIG. 22, may be manually adjusted in the same manner as in the Philishave 930 model and in European Patent 0231966, or automatically in the same manner as described in U.S. Pat. No. 5,687,481, and therefore these two patents are incorporated herein by reference.

Auxiliary Device for Drying and/or Cleaning

Figure 23:
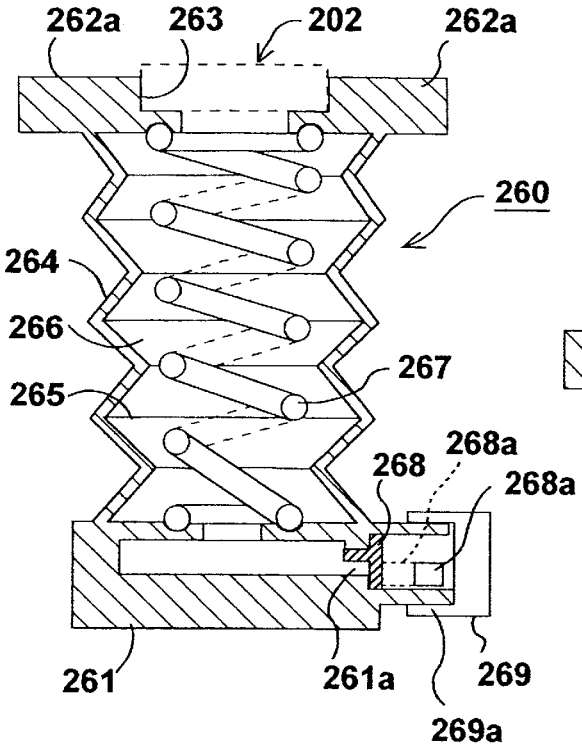
FIG. 23 is a longitudinal sectional view illustrating one form of auxiliary device useful with the described electrical shaver to facilitate drying and/or cleaning the shaver head, the device of FIG. 23 being shown in its expanded condition.
Figure 24:
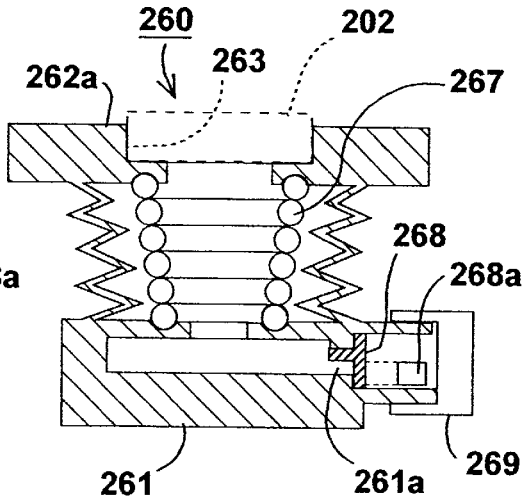
FIG. 24 is a corresponding view of the device of FIG. 23 shown in its contracted condition.
Figure 25:
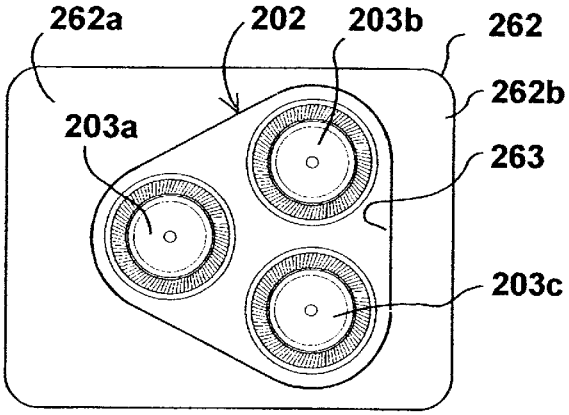
FIG. 25 is a top plan view of the device of FIGS. 23 and 24 showing particularly the manner it receives the shaver head assembly.

FIGS. 23–25 illustrate a bellows-type auxiliary device which may be used to facilitate drying the shaver head (e.g., 2, FIG. 1) after it has been used for a wet shave and water-rinsed after detached from the shaver housing, or to facilitate cleaning the shaver head after it has been used for a dry shave.

The illustrated auxiliary device includes a housing, generally designated 260, formed with a base 261 at its lower end for stably supporting the device on a horizontal surface. Housing 260 further includes an upper wall 262 formed with a socket 263 of the same triangular configuration as the shaver head 202 for receiving the shaver head, preferably with the outer surface of the shaver head facing upwardly and projecting slightly outwardly of the socket 263. Socket 263 is configured to receive the shaver head 202 with a press-fit and to retain it within the socket, but to permit a portion of the shaver head to project outwardly of the socket (FIGS. 23, 24) and to be manually grasped for removing the shaver head from the socket.

Housing 260 further includes a side wall 264, of circular or rectangular cross-section, formed with a plurality of transversely-extending fold lines 265 alternating in direction so as to define a bellows-type expansible/contractable chamber 266. A coil spring 267 is provided within chamber 266, with the opposite ends of the spring bearing against base 261 and the upper wall 262, to urge the bellows to its normal expanded condition as illustrated in FIG. 23. The upper wall 262 is sufficiently larger than the socket 263 receiving the shaver head 202 so as to define surfaces 262*a*, 262*b* on opposite sides of the shaver head 202 for manually pressing wall 262 downwardly to contract chamber 266 against the force of the spring 267.

It will thus be seen that after the shaver head 202 has been water-rinsed and while detached from the shaver housing (1, FIG. 1), it may be applied to socket 263 of the bellows, and then, by alternatingly pressing-down and releasing surfaces 262*a*, 262*b* of the bellows, chamber 266 of the bellows is alternatingly contracted and expanded, thereby impelling air in both directions through the shaver head to dry it.

The bellows device illustrated in FIGS. 23–25 may also be used for cleaning the shaver head of a conventional electrical shaver after it has been used for a conventional dry shave. For this purpose, base 261 of the bellows device is preferably formed with an opening 261*a* for discharging air from chamber 266 when the chamber is contracted. Opening 261*a* is closed by a one-way valve 268, in this case an umbrella valve, which permits the outflow of air from chamber 266 to the atmosphere, but blocks the inflow of air from the atmosphere into the chamber. Outlet opening 261*a* may be covered by a replaceable filter 269 which removes the shaven hair from the air before the air is discharged to the atmosphere.

FIG. 23 illustrates a further optional feature which may be included, namely the provision of a selector 268*a*, which may be moved to one position (the full-line position in FIG. 23) enabling the one-way valve 267 to permit the outflow of the air but to block the inflow of the air, or to a second position (the broken-line position in FIG. 23) blocking both the outflow and the inflow of the air. If selector 268*a* is provided, it would be moved to its blocking position for drying a water-rinsed shaver head after it has been used to take a wet shave, and moved to its enabling position for air-cleaning the shaver head if it has been used to take a conventional dry-shave. In the latter case, the user would place the palm of the hand over the shaver head 202 to block the inflow of air into chamber 266 during the downward, contracting movement of the bellows, and would remove the hand to permit the spring-return expansion of the chamber, thereby drawing air into the chamber via the shaver head such that the shaven hairs therein would also be drawn into the chamber. Such hairs would be expelled from chamber 266 via filter 268 during the expansion of the chamber when the bellows is next compressed.

The provision of the one-way valve 267 and the selector 268*a* thus forces the shaven hair removed from the shaver head through the filter 268. Such filter may be replaced whenever desired, e.g., by providing a threaded connection or press-fit connection between its connector section 269*a* and base 261. It will also be appreciated that the one-way valve and the selector may be omitted, in which case the shaven hairs will be discharged from the shaver head directly into the atmosphere.

Figure 26:
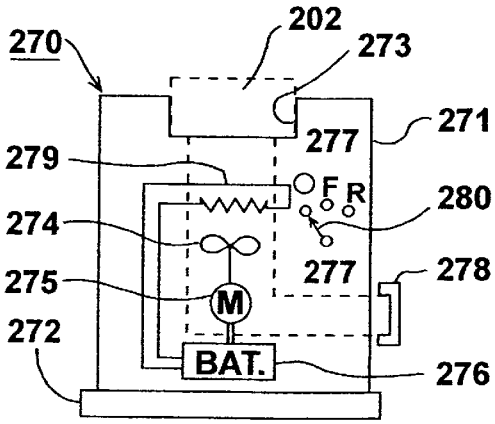
FIG. 26 schematically illustrates another form of auxiliary device that may be used with the described electrical shaver.

FIG. 26 illustrates a power-driven auxiliary device, generally designated 270, which may be used for drying a shaver head when used to take a wet-shave as described above. Thus, the device 270 illustrated in FIG. 26 also includes a housing 271 having a flat base 272 for stably supporting it on a horizontal surface, and formed at its upper end with a socket 273 dimensioned to receive and retain the shaver head 202. Housing 271 includes an impeller 274 in the form of a blade rotated by an electrical motor 275 supplied from a battery 276, which impeller impels the air through a duct 277 leading from socket 273 to the outlet of the housing optionally covered by a filter 278. An electrical heater 279 supplied by battery 276 may also be enclosed within housing 271 to heat the air blown through the shaver head 202 for accelerating the drying of the shaver head after a wet shave.

Housing 271 further includes a selector switch 280 which may be moved to any one of three positions: (1) an Off position (O); (2) a Forward position (F) for energizing motor 275 in the forward direction to air-dry the shaver head 202 after a wet shave, in which case heater 279 would be energized; and (3) a Reverse position (R) for energizing motor 275 in the reverse direction in order to vacuum clean the shaver head after a dry shave, in which case the filter 278 would remove the shaven hair from the air before the air is discharged into the atmosphere.

Summary of Operation and Advantages

It will thus be seen that the illustrated electrical shavers may be used in the conventional manner as a conventional electrical shaver for dry shaving, but can also be used for wet shaving, i.e., by applying wet soap to the surface to be shaved. Thus, when using the shaver with wet soap, the sealing end wall 10 between the shaver head 2 and the motor 4 within housing 1, prevents liquid from penetrating into the housing and reaching the motor. The motor drives the cutter units 3*a*—3*a* via the drive magnets 11–13 on one side of the sealing end wall 10 which produce a magnetic coupling with the driven magnets 21–23 located in the shaver head assembly 2 on the opposite side of the end wall and mechanically coupled to the three cutter heads 3*a*–3*c*.

After a shave has been completed, the shaver head assembly 2 may be removed from the shaver housing 1 by depressing button 9 (FIG. 1) to detach the shaver head assembly and then water-rinsing it as rinsing a conventional razor blade. The shaver head assembly 2 should be dried before it is reattached to the shaver housing 1, e.g., by the use of the auxiliary device of FIGS. 23–26.

When the illustrated electrical shaver is used to take a wet shave, it provides many of the advantages discussed above of the wet shave, together with the advantages of the electrical shaver dry shave. Thus, using wet soap permits otaining a clean, close shave, comparable to that obtained the conventional wet shave, particularly when the shaver includes the scraper member feature of FIGS. 20–22. The shaver head may be conveniently cleaned by merely rinsing it under water. The illustrated electrical shaver also provides the convenience of shaving whenever desired, the reduced danger of nicking cutting, or irritating the skin, and the elimination of the need for frequent replacement of the blades or the use of expensive shaving creams and lathers since plain facial soap is generally sufficient. A still further important advantage, particularly in the implementation of FIGS. 1–12, is that very little redesign is required of the existing rotary-type electrical shavers.

Some Other Possible Variations

If a vibrator-type trimmer is also to be included in the electrical shaver (as in the present commecial model of the rotary-type shaver referred to above), the magnetic coupling arrangement illustrated in FIG. 19 may be used; alternatively, a conventional mechanical coupling can be provided through a sealed opening in the shaver housing in view of the very small vibrational movements involved.

If it is desired to completely seal the shaver housing (e.g., to enable the shaver also to be used in the shower), a rubber cap may be provided at the opposite end of the shaver housing 1 (opposite to that of the removable shaver head assembly 2) to sealingly cover the plug at that end of the housing.

It will be further appreciated, that the magnetic coupling arrangement can be used without the scraper member, that the scraper member can be used without the magnetic coupling, and that the shaver head assembly 2 may be pivotally mounted as in some commercial modes, to enable it to be moved to its closed operative position or open cleaning position, rather than removably mounted as described above. Further, while it is preferred to make the scraper members (232, FIGS. 20, 21, or 242 FIG. 22) of metal, they may also be of a plastic provided they define a thin, hard sraper edge to produce the scraper action described above.

It will be appreciated that many other variations, modifications and applications of th invention may be made.

What is claimed is:

1. An electrical shaver, comprising: a housing including an electrical motor within the housing, and at least one cutter head carried by said housing and coupled to said electrical motor so as to be driven thereby; characterized in that said housing includes a sealing end wall blocking the passage of liquid from the cutter head to the electrical motor; and in that said cutter head is magnetically coupled to said electrical motor, so as to be driven thereby, by a magnetic field which penetrates said sealing end wall.

2. The shaver according to claim 1, wherein said cutter head is magnetically coupled to said electrical motor by at least one drive magnet on one side of said sealing end wall mechanically coupled to said electrical motor, and at least one driven magnet on the opposite side of said sealing end wall mechanically coupled to said cutter head.

3. The shaver according to claim 2, wherein said cutter head and said driven magnet are carried by a shaver head assembly mounted on said housing so as to assume either a closed, operative position magnetically coupling said drive magnet to said driven magnet for driving the cutter head, or an open, cleaning position opening the cutter head for cleaning it and the driven magnet mechanically coupled thereto.

4. The shaver according to claim 3, wherein said shaver head assembly is removably attachable to said housing so as to be in said operative position when attached to the housing, and in said cleaning position when detached from the housing.

5. The shaver according to claim 3, wherein said shaver head assembly includes a removable retainer member effective, when in retaining position to retain the cutter head and the driven magnet coupled thereto within the shaver head assembly and when removed from the shaver head assembly, to permit the cutter head and the driven magnet coupled thereto to be removed from the shaver head assembly for cleaning or replacement; said driven magnet in the shaver head assembly being rotatably carried by said retainer member.

6. The shaver according to claim 3, wherein each of said magnets is in the shape of a disc.

7. The shaver according to claim 3, wherein said shaver head assembly includes a plurality of cutter heads each having a rotary cutter member driven by said electrical motor within said housing when the shaver head assembly is attached to the housing.

8. The shaver according to claim 7, wherein said housing includes a drive magnet on one side of the sealing end wall for each of said rotary cutter members and mechanically coupled to the electrical motor; and said shaver head assembly includes a driven magnet on the opposite side of the sealing end wall for, and mechanically coupled to, each of said rotary cutter members.

9. The shaver according to claim 7, wherein said housing includes a single drive magnet on one side of the sealing end wall for all of said rotary cutter members and mechanically coupled to the electrical motor; and said shaver head assembly includes a single driven magnet on the opposite side of the sealing end wall and mechanically coupled to all said rotary cutter members.

10. The shaver according to claim 7, wherein said shaver head assembly includes three cutter heads arranged in a triangular array.

11. The shaver according to claim 7, wherein said shaver head assembly includes a retainer member rotatably carrying said driven magnets; said retainer member being removably attachable to said shaver head assembly such that, when attached, it mechanically couples the driven magnets to their respective rotary cutter members, and when detached, it permits cleaning or replacement of the respective rotary cutter members.

12. The shaver according to claim 1, wherein said cutter head includes a rotary cutter member, a static cutter member enclosing the rotary cutter member and formed with a plurality of slots for reciving hairs to be cut by the rotary cutter member as the static cutter member is pressed against and moved over a surface containing the hairs to be cut; and a scraper member having a thin, hard, scraper edge at least partially enclosing said static cutter member and spaced radially from its outer edge effective to erect the hairs, and to taughten said surface containing the hairs, as the static cutter member is moved over, while pressed against, said surface containing the hairs to be cut.

13. The shaver according to claim 12, wherein said static cutter member is of cylindrical configuration and is closed at on end by an end wall which is pressed against the surface containing the hairs to be cut, said scraper member being of cylindrical configuration enclosing, and of slightly larger diameter than, said static cutter member.

14. The shaver according to claim 12, wherein there are a plurality of said cutter heads, each including a rotary cutter member, a cylindrical static cutter member, and a cylindrical scraper member of slightly larger outer diameter than its respective static cutter member.

15. The shaver according to claim 12, wherein said scraper member is axially adjustable with respect to the outer edge of said static cutter member.

16. The according to claim 12, wherein there are a plurality of said cutter heads each including a rotary cutter member enclosed by a static cutter member, and a common scraper member enclosing, and radially spaced from, the static cutter members of all the cutter heads.

17. The shaver according to claim 12, wherein there are a plurality of said cutter heads carried on a shaver head assembly removable from said housing for cleaning or repair purposes.

18. The shaver according to claim 1, wherein said housing includes a rechargeable battery for powering the electrical motor therein.

19. An electrical shaver, comprising; a housing closed at one end by a sealing end wall, said housing including an electrical motor and a drive magnet at one side of said sealing end wall mechanically coupled to said electrical motor; and a shaver head assembly at one end of the housing, said shaver head assembly including a cutter head and a driven magnet mechanically coupled thereto located at the opposite side of said sealing end wall; said driven magnet being magnetically coupled to said drive magnet by a magnetic field penetrating said sealing end wall when the shaver head assembly is attached to said housing.

20. The shaver according to claim 19, wherein said shaver head assembly includes a plurality of cutter heads each having a rotary cutter member driven by said electrical motor within said housing via said magnetic coupling when the shaver head assembly is attached to the housing.

21. The shaver according to claim 20, wherein said housing includes a drive magnet on one side of the sealing end wall for each of said rotary cutter members and mechanically coupled to the electrical motor; and said shaver head assembly includes a driven magnet on the opposite side of the sealing end wall for, and mechanically coupled to, each of said rotary cutter members.

22. The shaver according to claim 21, wherein said shaver head assembly is removably attached to said housing and includes a retainer member rotatably carrying said driven magnets; said retainer member being removably attachable to said shaver head assembly such that, when attached, it mechanically couples the driven magnets to their respective rotary cutter members, and when detached, it permits cleaning or replacement of the respective rotary cutter members.

23. The shaver according to claim 19, wherein said housing includes a single drive magnet on one side of the sealing end wall for all of said rotary cutter members and mechanically coupled to the electrical motor; and said shaver head assembly includes a single driven magnet on the opposite side of the sealing end wall and mechanically coupled to all said rotary cutter members.

* * * * *